United States Patent [19]

Smith-Johannsen et al.

[11] 4,286,376

[45] * Sep. 1, 1981

[54] METHOD OF MAKING HEATER CABLE OF SELF-LIMITING CONDUCTIVE EXTRUDATES

[75] Inventors: Robert Smith-Johannsen; Jack M. Walker, both of Portola Valley, Calif.

[73] Assignee: Raychem Corporation, Menlo Park, Calif.

[ * ] Notice: The portion of the term of this patent subsequent to Jan. 21, 1992, has been disclaimed.

[21] Appl. No.: 868,517

[22] Filed: Jan. 11, 1978

Related U.S. Application Data

[60] Continuation of Ser. No. 542,592, Jan. 20, 1975, abandoned, which is a division of Ser. No. 287,444, Sep. 8, 1972, Pat. No. 3,861,029.

[51] Int. Cl.[3] ..... H05B 03/10

[52] U.S. Cl. ..... 29/611; 29/610 R; 264/105; 264/346; 338/214

[58] Field of Search ..... 29/610, 611; 264/235, 264/346, 105; 338/214

[56] References Cited

U.S. PATENT DOCUMENTS

| | | | |
|---|---|---|---|
| 2,905,919 | 9/1959 | Lorch | 338/224 |
| 3,435,401 | 3/1969 | Epstein | 338/214 |
| 3,760,495 | 9/1973 | Meyer | 29/610 |
| 3,793,716 | 2/1974 | Johannsen | 164/105 X |
| 3,823,217 | 7/1974 | Kampe | 164/105 |
| 3,861,029 | 1/1975 | Johannsen | 219/544 X |
| 3,914,363 | 10/1975 | Bedard | 164/105 |

OTHER PUBLICATIONS

Birks, Modern Dielectric Material, 1960, Heywood & Co., London, p. 105 relied on.

*Primary Examiner*—Richard R. Kucia
*Attorney, Agent, or Firm*—Lyon & Lyon

[57] ABSTRACT

Described herein are self-regulating conductive articles comprised of an extruded length of polymeric material containing not more than about 15% by weight conductive carbon black, the resistivity of the extrudate following prolonged exposure to temperatures in excess of the crystalline melting point or range of the polymeric matrix in which the black content satisfies the equation:

$$2L+5\log_{10}R \leqq 45.$$

Wherein L is percent by weight black and R is resistivity of the extrudate expressed in ohm-cm. The articles exhibit room temperature resistivity in the range from about 5 to 100,000 ohm-cm and may be employed, e.g., in heat tracing and thermostating applications.

7 Claims, 2 Drawing Figures

METHOD OF MAKING HEATER CABLE OF SELF-LIMITING CONDUCTIVE EXTRUDATES

This is a continuation of application Ser. No. 542,592 filed Jan. 20, 1975, now abandoned, which is a division of application Ser. No. 287,444 filed Sept. 8, 1972, now U.S. Pat. No. 3,861,029.

BACKGROUND OF THE INVENTION

Electrically conductive thermoplastic compositions have previously been achieved by the addition of conductive carbon black to a polymeric base. In one category of such compositions, advantage has been taken of a non-linear positive temperature resistivity coefficient displayed by the particular material to obtain self-regulating or current-limiting semiconductive articles. In U.S. Pat. No. 3,243,753 to Kohler, one such composition is described as containing from 25% to 75% carbon black about which the polymeric matrix has been formed by in situ polymerization. As the temperature of such a composition increases, either through a rise in ambient temperature or by reason of resistive heating occasioned by the passage of current therethrough, the polymer matrix expands at a rate greater than that of the carbon black particles which, in an interconnected array of channels, impart the property of conductivity. The resulting diminution in the number of current-carrying channels decreases the amount of power generated by $I^2R$ heating. This self-limiting feature may be put to work in, eg, heat tracing pipes in chemical plants for freeze protection, maintaining flow characteristics of viscous syrups, etc. In such applications, articles formed from the conductive composition ideally attain and maintain a temperature at which energy lost through heat transfer to the surroundings equals that gained from the current. If the ambient temperature then falls, increased heat transfer to the surroundings is met by increased power generation owing to the resistivity decrease associated with the article's lowered temperature. In short order, parity of heat transfer and power generation is again attained. Conversely, where ambient temperature increases heat transfer from the conductive article is reduced and the resistivity rise resulting from increased temperature diminishes or stops $I^2R$ heating.

Self-regulating conductive compositions may, of course, be used in employments other than resistive heating, for example, in heat sensing and circuit-breaking applications. In every case, however, the high carbon black content characteristic of most prior art compositions is disadvantageous. High black loadings are associated with inferior elongation and stress crack resistance, as well as low temperature brittleness. In addition, high black loading appears to adversely affect the current-regulating properties of the conductive compositions. If a semi-conductive thermoplastic composition is externally heated and its resistivity plotted against temperature (on the abscissa) the resulting curve will show resistivity rising with temperature from the low room temperature value (Ri) to a point of "peak resistance" (Rp), following which additional increase in temperature occasions a precipitous resistivity drop associated with the melt phase of the polymer matrix. To avoid resistance runaway with the concomitant irreversible change in resistivity characteristics, the practice of cross-linking the polymer matrix has grown up, in which event resistivity levels off at the peak temperature and remains constant upon further increase in ambient temperature. Cross-linked semi-conductive articles with high black loadings exhibit undesirably low resistivity when brought to peak temperature by exposure to very high or low ambient temperatures. In such instances poor heat transfer characteristics can prevent dissipation of $I^2Rp$ generation, causing burnout.

It would accordingly be desirable to prepare semi-conductive self-regulating articles with substantially lower black contents, with the objects, inter alia, of improving flexural and other physical properties and substantially increasing the ratio Rp/Ri. However, attainment of these goals has in large part been precluded by the extremely high room temperature resistivities exhibited by polymers with low black loadings. In Cabot Corporation's Pigment Black Technical Report S-S, entitled "Carbon Blacks for Conductive Plastics" percent carbon-resistivity curves for various polymers containing "Vulcan XC-72", an oil furnace black, show resistivities of 100,000 ohm-cm or more, asymptotically increasing at black loadings of about 15%. Others have reported similarly high resistivities with low black loads. Recently resistivities sufficiently low for freeze protection applications have been achieved with low black loadings by resort to the special deposition techniques, such as solvent coating, disclosed in commonly assigned copending U.S. Patent Application Ser. No. 88,841, filed Nov. 12, 1970 by Robert Smith-Johannsen, and now abandoned. Self-limiting compositions have been extruded heretofore, eg, U.S. Pat. No. 3,435,401 to Epstein, but when low black loading has been attempted the extrudates have exhibited room temperature resistivities of $10^7$ ohm-cm or higher, essentially those of the polymer matrices themselves. Indeed, the patentees in G.B. Pat. No. 1,201,166 urge the avoidance of hot melt techniques where significant conductivities are desired with less than about 20% black.

SUMMARY OF THE INVENTION

We have now for the first time obtained self-limiting extrudates advantaged by low black loading yet exhibiting room temperature (hereafter, 70° F.) resistivities in the useful range from about 5 to about 100,000 ohm-cm, the relation of the carbon black loading and room temperature resistivity satisfying the equation $$2\,L+5\,\log_{10}R \leqq 45$$

wherein L is the percentage by weight of the carbon black in the extruded composition. After extrusion in conventional fashion, we have learned, resistivity can be greatly reduced by subjection of the yet uncross-linked article to thermal structuring according to a time-temperature regime far more severe than that which heretofore has been employed for strain relief or improved electrode wetability, eg, exposure to 300° F. for periods on the order of 24 hours. The resulting articles are suitable for freeze protection and other self-limiting applications, exhibit high Rp/Ri, and are otherwise advantaged by low black content. In particular and unlike extrudates with high black content, their resistivity-temperature properties are stable in storage and unaffected by temperature cycling.

The manner in which these and other objects and advantages of the invention are attained will become apparent from the detailed description which follows and from the accompanying drawing in which:

FIG. 1 is a cross-section end-on view of one jacketed extrudate formed according to the practice of this invention; and FIG. 2 is a flow chart which depicts the steps of the preferred manner of obtaining jacketed extrudates like those depicted in FIG. 1.

DETAILED DESCRIPTION OF THE INVENTION

Figure 1:
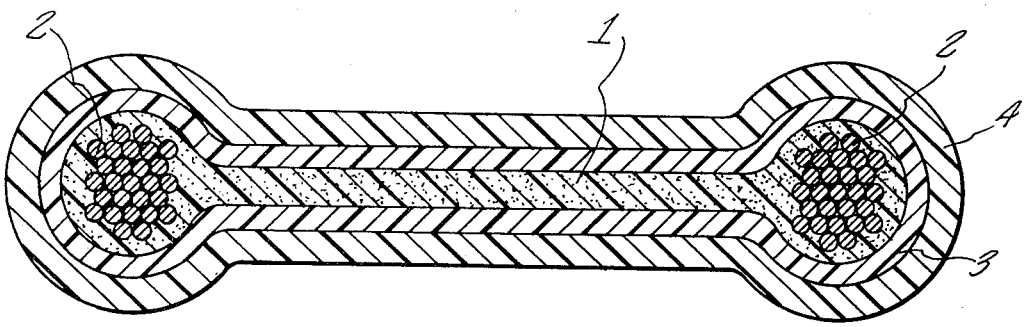

In order to obtain self-limiting compositions, the polymeric matrix in which conductive black is dispersed in whatever proportion must exhibit overall an appropriately non-linear coefficient of thermal expansion, for which reason a degree of crystallinity is believed essential. Generally, polymers exhibiting at least about 20% crystallinity as determined by x-ray diffraction are suited to the practice of the invention. Among the many polymers with which the invention may be practiced are polyolefins such as low, medium and high density polyethylenes and polypropylene, polybutene-1, poly(-dodecamethylene pyromellitimide), ethylenepropylene copolymers and terpolymers with non-conjugated dienes, polyvinylidine fluoride, polyvinylidine fluoride-tetrafluoroethylene copolymers, etc. As will be recognized by those skilled in the art, limiting temperatures tailored to the application intended (eg, freeze protection, thermostatting, etc.) may be obtained by appropriate selection of polymeric matrix material. For example, elements which self-limit at temperatures on the order of 100° F., 130° F., 150° F., 180° F. and 250° F. may be produced with, respectively, wax-poly(ethylenevinyl acetate) blends, low density polyethylene, high density polyethylene, polypropylene and polyvinylidene fluoride. Other criteria of polymer selection will, in particular instances, include desired elongation, environmental resistance, case of extrusibility, etc. as is well known.

Particularly preferred matrix materials are multicomponent blends in which black is mixed with a first blend component to form a master batch which is in turn mixed with the principal polymeric component. The first and second polymer blend components are chosen such that they exhibit a positive free energy of mixing, one with the other. Their attendant incompatibility apparently has the effect of segregating contained black into generally delimited regions of the polymer matrix, and such blends have proven extremely stable in the face of temperature cycling in use. In the case of single component matrices, cycling has occasionally had the effect of requiring that successively higher temperatures be attained to provide identical wattage values. Of course, even in the case of single component matrices, the low black loadings achieved according to this invention can result in satisfactory stability to cycling. Typically, the minor polymeric blend component is chosen for superior compatibility with carbon black relative to the blend component present in major proportion, while the latter component is selected for the particular physical properties desired in the overall extrudate. The principal blend component is preferably present in at least about 3:1 weight ratio relative to the minor component with which the black is first mixed. Presently, the blends most preferred have a polyethylene as the principal component, the other being an ethylene-vinyl ester copolymer, such as ethylene-vinyl acetate or ethyleneethylacrylate copolymers. An especially preferred extrudate contains about 70:20 polyethylene: ethylene-ethyl acrylate copolymer by weight.

The carbon blacks employed are those conventionally used in conductive plastics, eg, high structure varieties such as furnace and channels blacks. Other conventional addends such as antioxidants, etc., may be employed provided only that their quantities and characteristics do not subvert the objects of the invention. An especially interesting class of beneficial addends, it has been found, are materials such as waxes which, while compatible with the predominant blend component, melt at lower temperature. The result is to permit obtainment of a given wattage at lower temperature, owing to a first peaking effect of the wax on the resistivity-temperature curve. Compounding is conventional and generally involves banburying, milling and pelletizing prior to pressure extrusion of the self-limiting element from the melt.

Figure 2:
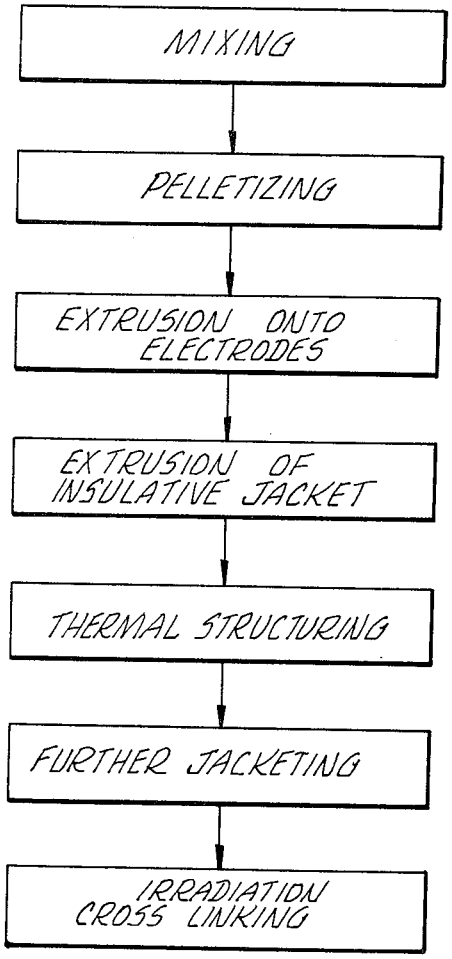

In the preferred embodiment, as will appear from FIG. 1, the black-containing matrix 1 is extruded onto a spaced-apart pair of elongate electrodes 2 to form an element rod-shaped or, most preferably, dumbbell-shaped in cross-section, the extruded thermoplastic both encapsulating and interconnecting the electrodes. Thereafter, polymeric jackets 3 and 4 may be extruded thereover, as in the fourth and sixth steps of the flow chart which is FIG. 2.

Now, in the freeze protection applications in which self-limiting elements are most commonly employed it is desirable that at least about 4–8 watts per foot be available for transfer to ambient. With commonly available voltages ranging from 120 to 480 volts, resistivity values must be in the range from about 6,000 to 100,000 ohm-cm in order to generate 4 watts per foot and, of course, lower at a particular voltage to obtain as much as 8 watts/foot. However, we have found that following extrusion of compound containing not more than about 15% by weight carbon, room temperature resistivity is greater than about $10^7$ ohm-cm, and most commonly on the order of the resistivity of the dielectric polymer matrix itself. At such resistivities available wattage under power is essentially zero. We have learned that enormous increases in conductivity of such extrudates may be obtained by subjecting the extrudate to temperatures above the melt for periods substantially longer than those which heretofore have been employed to improve electrode wetting, etc., when self-limiting articles are achieved by other methods. By so doing, we having attained resistivities ranging from 5 to about 100,000 ohm-cm with carbon contents not greater than about 15%, and indeed have commonly achieved room temperature resistivities well below 10,000 ohm-cm even at black loadings less than about 10%. The thermal structuring process apparently involves microscopic movement of carbon particles of a sort not commonly associated with "annealing", although that term is employed herein for the sake of convenience.

Annealing is performed at a temperature greater than about 250° F., preferably at at least about 300° F., and in any case at or above the melting point or range of the polymeric matrix in which the carbon black is dispersed. The period over which annealing is effected will, it will be appreciated, vary with the nature of the particular matrix and the amount of carbon black contained therein. In any case, annealing occurs over a time sufficient to reduce resistivity of the annealed element to satisfaction of the equation $2\ L+5\ \log_{10} R \leqq 45$, preferably $\leqq 40$, and the time necessary in a particular case may be readily determined empirically. Typically, annealing is conducted over a period in excess of 15 hours, and commonly at least about a 24 hour anneal is had. Where the element is held at anneal temperature continuously throughout the requisite period, it is advisable to control cooling upon completion of the anneal so that at least about one and one-half hours are required to regain room temperature. However, it has been learned that control of cooling is substantially less important where the requisite overall annealing residence time is divided into at least about 3 roughly equal stages, and the element returned to room temperature between each annealing stage.

Because the polymeric matrix of the black-containing extrudate is in the melt during annealing, that extrudate is preferably supplied prior to annealing, with an insulative extruded jacket of a thermoplastic material which is shape-retaining when brought to the annealing temperature. Jacketing materials suitable for the preferred embodiments of this invention are set out in the Examples which follow, and are discussed at length in the commonly assigned application entitled SELF-LIMITING CONDUCTIVE EXTRUDATES AND METHODS THEREFOR, Ser. No. 287,444 (now abandoned) filed concurrently herewith, the disclosure of which is incorporated herein by reference.

Upon completion of annealing and optional addition of a further insulative jacket of, e.g., polyethylene, the self-limiting element is desirably subjected to ionizing radiation sufficient in strength to cross-link the black-containing core. Radiation dosage is selected with an eye to achieving cross-linking sufficient to impart a degree of thermal stability requisite to the particularly intended application without unduly diminishing crystallinity of the polymer matrix, i.e., overall crystallinity of the cross-linked black-containing matrix less than about 20% is to be avoided. Within those guidelines, radiation dosage may in particular cases range from about 2 to 15 megarads or more, and preferably is about 12 megarads.

The invention is further described in the following Examples of preferred embodiments thereof, in which all parts and percentages are by weight, and all resistivities measured at room temperature and with a Wheatsone bridge unless otherwise indicated.

EXAMPLE 1

Seventy-six lbs. of polyethylene (density 0.929 gm/cc, 32 lbs. of a mixture of 34% Vulcan XC-72 and ethylene ethyl acrylate copolymer (density 0.930 gm/cc, 18% ethyl acrylate) were loaded with 1 lb. of antioxidant into a Banbury mixer. The ram was closed and mixing commenced. When temperature reached about 240°-50° F. the batch was dumped, placed in a 2-roll mill, and cut off in strips which were fed to a pelletizing extruder. The pelletized compound was next extruded onto two parallel tinned copper electrodes (20 AWG 19/32) to form an extrudate generally dumbbell-shaped in cross-section. The electrodes were 0.275 inch apart (center-to-center), the interconnecting web being about 15 mils in thickness, at least 8 mils thickness of the semiconductive composition surrounding the electrodes. Extrusion was performed in a plasticating extruder with crosshead attachment (Davis-Standard 2" extruder, 24/1 L/D, with PE screw. Thereafter, the same extruder was arranged to extrude an 8 mil thick insulation jacket of polyurethane (Texin 591-A, available from the Mobay Corporation). For optional geometric conformation, a conventional tube extrusion method was employed in which a vacuum (eg 5-20 in. $H_2O$) is drawn in the molten tube to collapse it about the semi-conductive core within about 3 in ches of the extrusion head. The jacketed product was next spooled onto aluminum disks (26" dia) and exposed to 300° F. for 24 hours in a circulating air oven. Following this thermal structuring procedure and cooling to room temperature oven about 1½ hours the resistivity of the sample was determined at various temperatures. The following data was taken.

TABLE I

| Resistivity Variance with Temperature | |
|---|---|
| T, °F. | R, ohm-cm |
| 60 | 4,800 |
| 80 | 5,910 |
| 100 | 9,600 |
| 120 | 20,950 |
| 140 | 69,900 |
| 160 | 481,500 |
| 180 | 6,150,000 |
| 200 | $>2 \times 10^7$ |

EXAMPLES 2-9

Additional extrudates were prepared with various polymers and black loadings following the procedure of Example 1 save where otherwise indicated below. The polymeric matrices for the various examples were as follows: (2) a 3:1 blend of low density polyethylene: ethylene ethyl acrylate copolymer; (3) a 5:1 blend of low density polyethylene: ethylene vinyl acetate copolymer; (4) polyvinylidene fluoride; (5) a 3:1 blend of medium density polyethylene: ethylene-ethyl acrylate copolymer; (6) a 3:1 blend of high density polyethylene: ethylene-ethyl acrylate copolymer; (7) ethylene/propylene copolymer (Eastman Chemical Company's "Polyallomer"); (8) polybutene-1; and (9) polyvinylidene fluoride/tetrafluoroethylene copolymer (Pennwalt Chemical Company's "Kynar 5200"). In the case of each blend, carbon black was first mixed with the minor component of the polymeric blend, and the resulting masterbatch mixed with the other polymeric component. The jacketed extrudate of each composition exhibited a non-linear positive resistivity temperature coefficient. The data reported in Table II was taken.

TABLE II

| Example | % Carbon | R(as extruded) ohm-cm | R(annealed) ohm-cm | Rp ohm-cm | Annealing Regimen | 2 L + 5 log R |
|---|---|---|---|---|---|---|
| 2 | 10 | $10^9$ | $5 \times 10^3$ | $>10^7$ @ 210° F. | 24 hrs. 300° F. | 38.5 |
| 3 | 10 | $10^9$ | 6050 | $2 \times 10^5$ @ 212° F. | 18 hrs. 350° F. | 38.9 |
| 4 | 13 | $10^{12}$ | 116 | $6 \times 10^3$ @ 325° F. | 2 hrs. 450° F. | 36.5 |
| 5 | 13 | $10^{11}$ | 393 | $2.82 \times 10^6$ @ 240° F. | 15 hrs. 300° F. | 39.0 |
| 6 | 5 | $10^{11}$ | 570 | $2.66 \times 10^6$ @ 280° F. | 20 hrs. 300° F. | 23.0 |
| 7 | 9 | $10^{12}$ | 5980 | $5.78 \times 10^6$ @ 220° F. | 20 hrs. 400° F. | 36.9 |
| 8 | 13 | $10^{10}$ | 434 | $1.59 \times 10^5$ @ 210° F. | 5 hrs. 300° F. | 39.2 |
| 9 | 13 | $10^{11}$ | 39.9 | 800 @ 250° F. | 4 hrs. 450° F. | 34.0 |

EXAMPLE 10

The procedure of Example 1 was repeated to obtain an identical polyurethane-jacketed extrudate. Thereafter, the extrudate was exposed to 300° F. for 9 3-hour periods separated by intervals in which the article was permitted to cool to room temperature. Thereafter, the annealed article was provided with a final insulative jacket of polyethylene (12 mils in thickness) by the tubing extrusion method and cross-linked throughout by exposure to a 1-Mev electron beam for a total dose of 12 megarads. The strip so produced exhibited the following resistivity values at the temperatures given in Table III.

TABLE III

| T °F. | R ohm-cm | T °F. | R ohm-cm |
|---|---|---|---|
| 60 | 4800 | 140 | 69,900 |
| 80 | 5910 | 160 | 481,500 |
| 100 | 9600 | 180 | 6,150,000 |
| 120 | 20,950 | 200 | $>2 \times 10^7$ |

We claim:

1. A method of forming an electrically conductive self-regulating article which comprises the steps of (1) extruding onto a pair of elongate parallel electrodes held in spaced-apart relation an electrode-interconnecting web of a composition consisting essentially of (a) a thermoplastic crystalline polymeric material exhibiting overall at least about 20% crystallinity as determined by x-ray diffraction and (b) conductive carbon black, the percentage by weight (L) of carbon black based on the total weight of said composition being not greater than about 15, the resulting extrudate exhibiting room-temperature resistivity (R, ohm-cm) greater than about $10^7$, and (2) annealing the extrudate at or above the melting temperature of said crystalline polymeric material for a period of time sufficient to reduce R to at least about 100,000, said annealed extrudate exhibiting a positive temperature coefficient of resistance.

2. A method according to claim 1 wherein annealing is performed at a temperature of at least about 300° F. for a period of time sufficient to reduce R to satisfaction of the equation $$2L+5 \log_{10} R \leqq 40.$$

3. A method according to claim 1 wherein L is not more than about 10 and annealing is performed at a temperature of at least about 300° F. over a period of not less than about 15 hours.

4. A method according to claim 1 wherein said composition is crosslinked after annealing.

5. A method according to claim 4 wherein said crosslinking is accomplished by ionizing radiation.

6. A method according to claim 1 wherein annealing is performed for a time sufficient to reduce R to satisfaction of the equation $2L+5 \log_{10} R \leqq 45$.

7. A method of forming an electrically conductive self-regulating article which comprises the steps of (1) extruding onto a pair of elongate parallel electrodes held in spaced-apart relation an electrode-interconnecting web of a composition consisting essentially of (a) a thermoplastic crystalline polymeric material exhibiting overall at least about 20% crystallinity as determined by x-ray diffraction and (b) conductive carbon black, the percentage by weight (L) of carbon black based on the total weight of said composition being not greater than about 15, the resulting extrudate exhibiting room temperature resistivity (R, ohm-cm) greater than about $10^7$, and (2) annealing the extrudate at or above the melting temperature of said crystalline polymeric material for a period of time sufficient to reduce R to at least about 100,000, said annealed extrudate exhibiting a positive temperature coefficient of resistance, wherein said annealing is in three approximately equal stages separated by periods of cooling to ambient temperature.

* * * * *